US005695370A

United States Patent [19]

Lin

[11] Patent Number: 5,695,370

[45] Date of Patent: Dec. 9, 1997

[54] MOTORBOAT PROPELLER

[76] Inventor: Solas Y.J. Lin, 37, 35th Road Taichung Industrial Park, Taichung, Taiwan

[21] Appl. No.: 604,424

[22] Filed: Feb. 21, 1996

[51] Int. Cl.[6] ..... B63H 1/14

[52] U.S. Cl. ..... 440/49; 416/244 B

[58] Field of Search ..... 440/38, 49, 66; 416/175, 177, 204, 244 R, 244 B, 245, 245 B, 245 A

[56] References Cited

U.S. PATENT DOCUMENTS

| | | | |
|---|---|---|---|
| 2,934,150 | 4/1960 | Fink | 416/245 |
| 4,790,725 | 12/1988 | Bousquet et al. | 416/245 R |
| 5,451,143 | 9/1995 | Lin | 416/244 B |

*Primary Examiner*—Jesus D. Sotelo
*Attorney, Agent, or Firm*—Browdy and Neimark

[57] ABSTRACT

A motorboat propeller comprises a hub and a plurality of blades mounted on the hub. The hub comprises peripherally along the axis thereof a front segment, a midsegment and a rear segment. The hub has a hollow interior provided therein with a shaft tube extending along the direction of the axis of the hub and corresponding in location to the midsegment of the hub. The midsegment has a recessed periphery. Located between the inner periphery of the midsegment and the outer periphery of the shaft tube is a connection portion having a correction end to facilitate the work of correcting the position of the center of gravity of the motorboat propeller. The midsegment of the hub can accommodate a greater amount of water for generating a greater backward thrust of water to propel the motorboat.

2 Claims, 4 Drawing Sheets

MOTORBOAT PROPELLER

FIELD OF THE INVENTION

The present invention relates generally to a motorboat propeller, and more particularly to a motorboat propeller which can be balanced and corrected easily.

BACKGROUND OF THE INVENTION

As shown in FIGS. 1 and 2, a prior art motorboat propeller 10 is made integrally and is composed of a main body 11 and three blades 12. The main body 11 of a conelike construction has an outer face 13 which is streamlined and projected outwards and is provided therein coaxially with a shaft tube 14 having an outer diameter smaller than the inner diameter of the inner edge portion of the main body 11. Fastened between the main body 11 and the inner and the outer edges of the shaft tube 14 are three ribs 15 spaced at an interval of 120 degrees.

As shown in FIG. 3, the propeller 10 is mounted in a motorboat such that the propeller 10 is located in a water duct 17 of the motorboat 16, and that the shaft tube 14 is fastened with an engine drive shaft 18 of the motorboat 16. As the shaft tube 14 is driven rapidly by the drive shaft 18, the water in the water duct 17 is compressed and forced out rapidly via the rear end of the water duct 17 so as to propel the motorboat 16 forward.

The propeller 10 is made by casting and is therefore prone to have a center of gravity which is located aside from the rotation axis. Such a structural defect as described above must be corrected in time to prevent the shortening of the service life span of the drive shaft 18 and the wear of the inner wall surface of the water duct 17 caused by the blades 12 in a high-speed motion.

Upon completion of the casting, the propeller 10 must be balanced and corrected so as to make sure that the center of gravity of the propeller 10 is located on the rotation axis of the propeller 10. The prior art method for correcting the location of the center of gravity of the propeller 10 involves the determination of a direction in which the rotating propeller 10 moves aside. The rotating blade 12 which moves aside in the direction is then ground so as to relocate the center of gravity of the propeller 10.

The grinding method described above is rather primitive and ineffective in that the relocation of the center of gravity of the propeller 10 can not be brought about precisely, and that the propelling effect of the blade 12, which is subjected to grinding, can be seriously undermined. In addition, the main body 11 of the prior art motorboat propeller 10 has a convex profile, which forms a smaller space 19 along with the inner wall of the water duct 17 and the blades 12. The smaller space 19 can weaken the propelling power of the motorboat 16 in view of the fact that the smaller space 19 can accommodate a smaller amount of water to result in a smaller backward thrust.

SUMMARY OF THE INVENTION

It is therefore the primary objective of the present invention to provide an improved motorboat propeller capable of being corrected for its rotational deviation.

It is another objective of the present invention to provide an improved motorboat propeller having a streamlined profile to accommodate a greater amount of water for generating effectively a greater backward thrust to propel the motorboat.

The motorboat propeller of the present invention comprises a hub and a plurality of blades fastened to the hub. The hub comprises peripherally along the axis thereof a front segment, a midsegment and a rear segment. The hub has a hollow interior provided therein with a shaft tube extending along the direction of the axis of the hub and corresponding in location to the midsegment of the periphery of the hub. The midsegment has a recessed outer periphery. Located between the inner periphery of the midsegment and the outer periphery of the shaft tube is a connection portion having a correction end which faces the rear end of the hub to facilitate the work of correcting the position of the center of gravity of the motorboat propeller. The midsegment of the hub can accommodate a greater amount of water for generating a greater backward thrust to propel the motorboat.

DETAILED DESCRIPTION OF THE INVENTION

Figure 2:
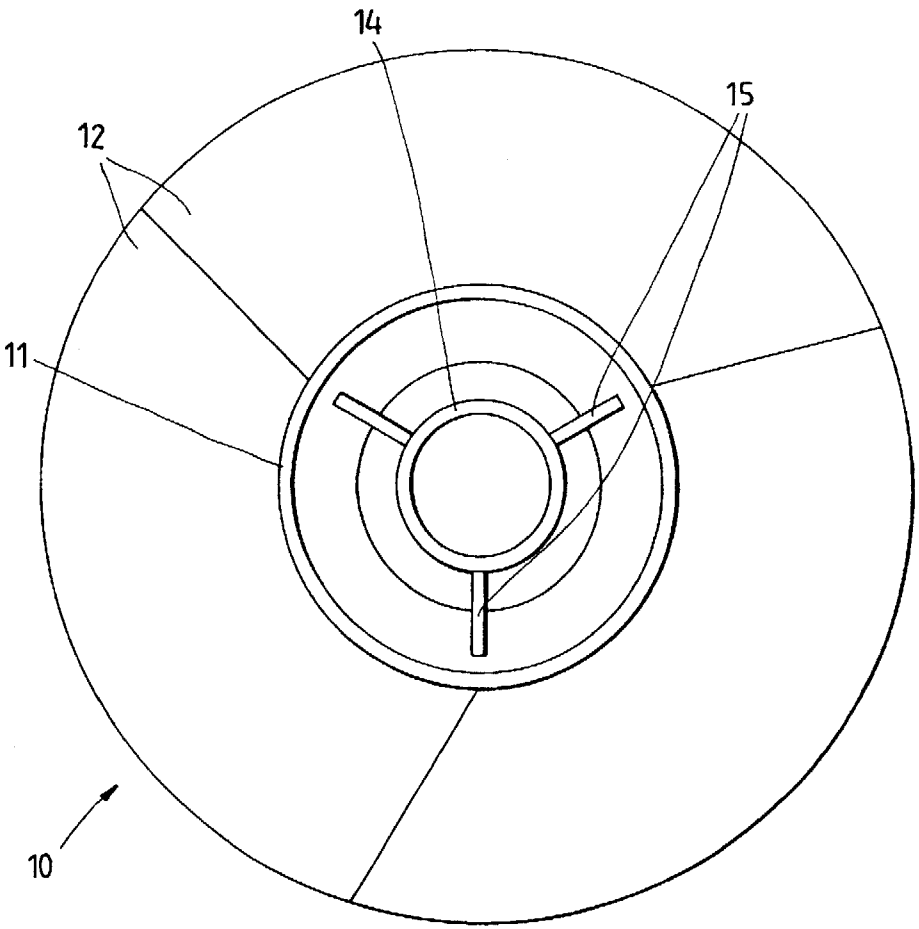
FIG. 2 shows a bottom view of the prior art motorboat propeller.
Figure 1:
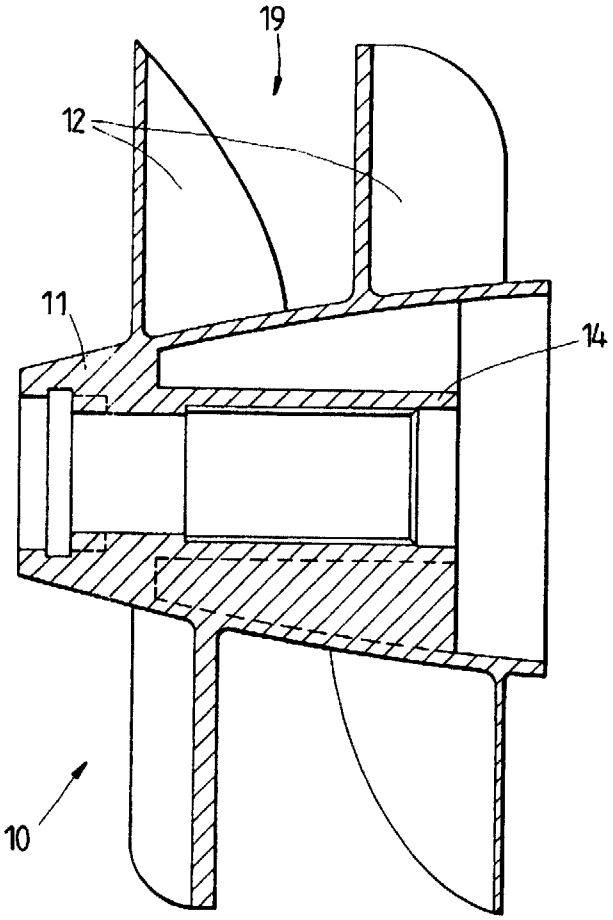
FIG. 1 shows a sectional view taken along the direction of the axis of a prior art motorboat propeller.
Figure 3:
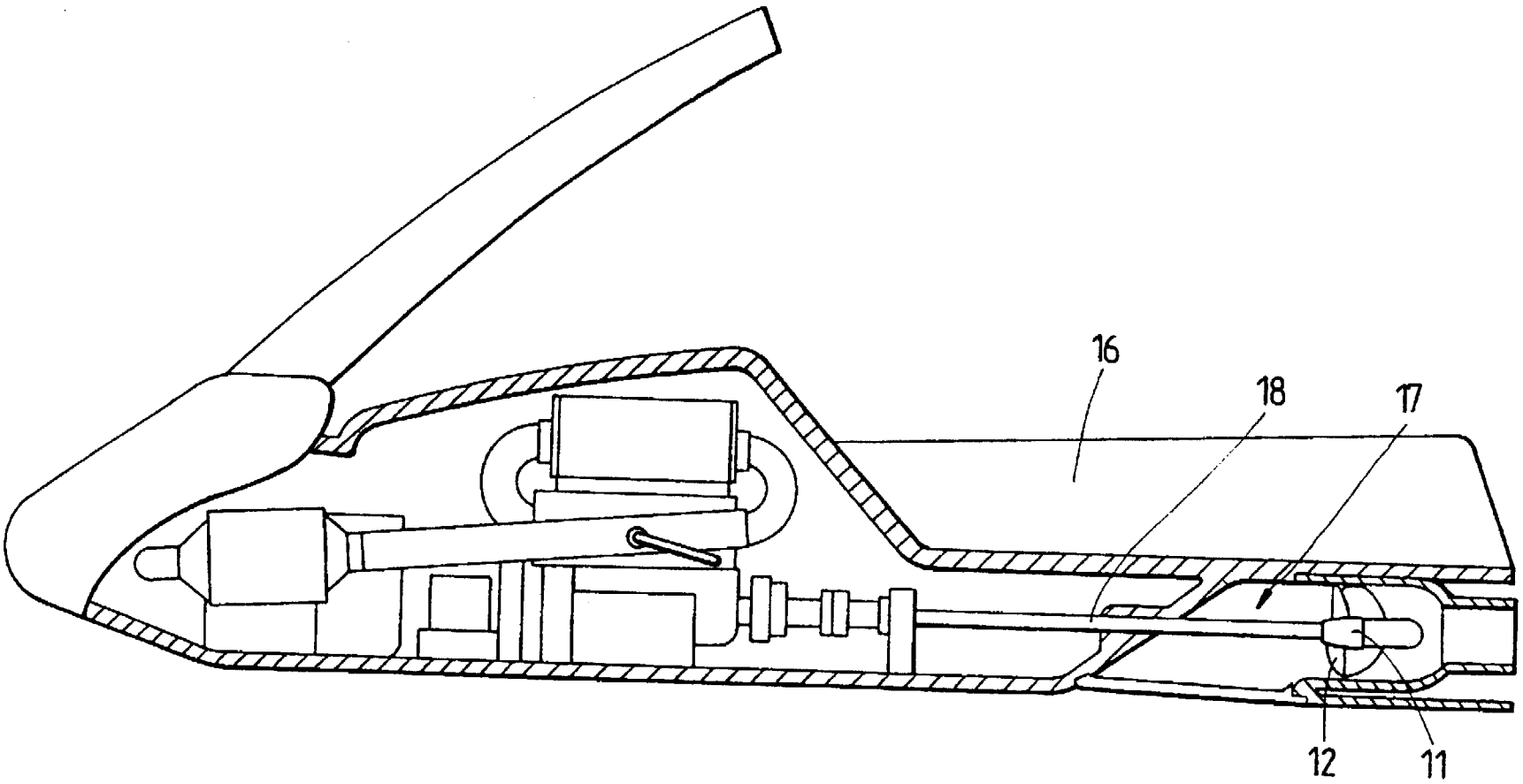
FIG. 3 shows a schematic view of the prior art motorboat propeller which is mounted in the motorboat.
Figure 4:
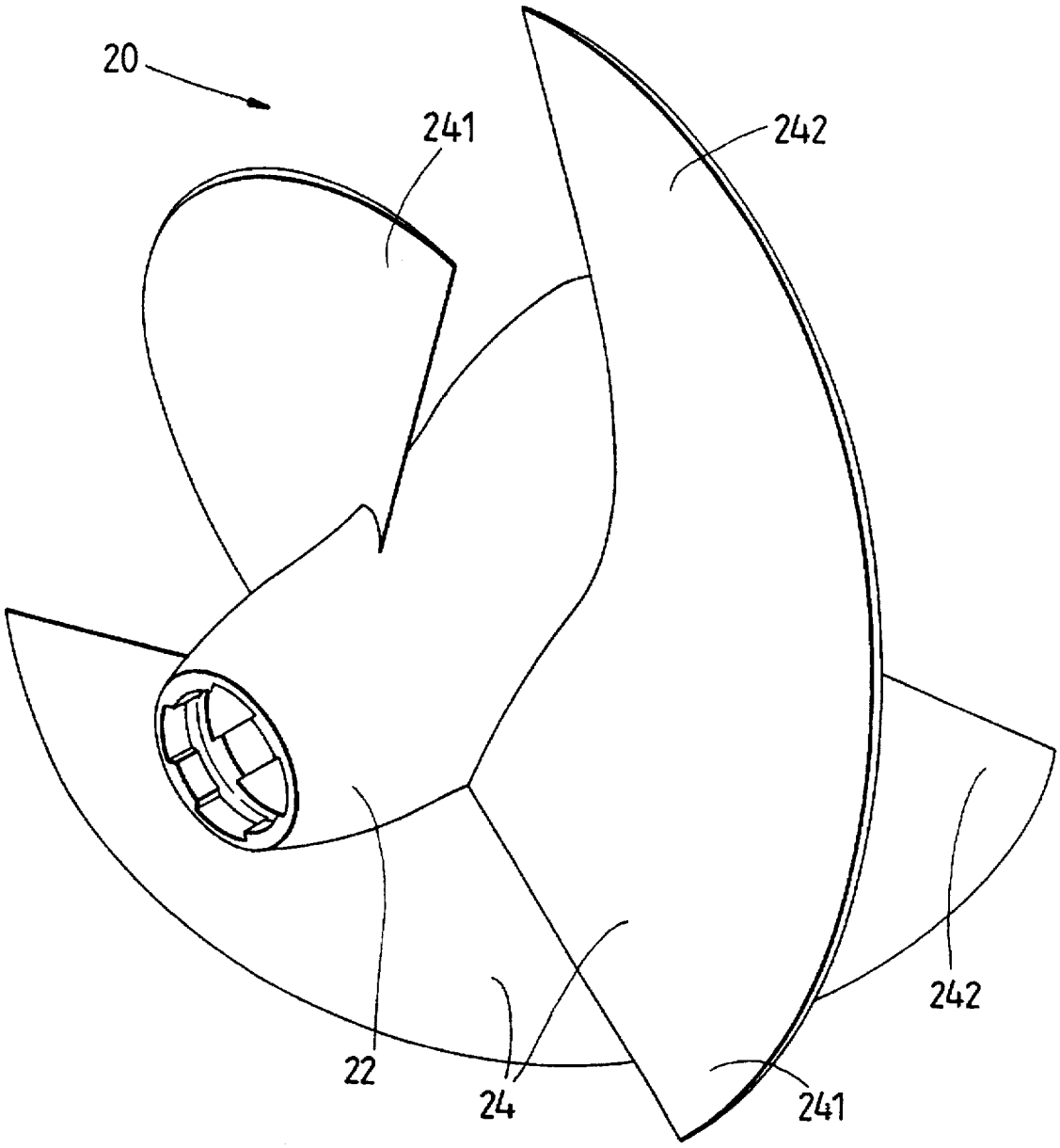
FIG. 4 shows a perspective view of a motorboat propeller embodied in the present invention.
Figure 6:
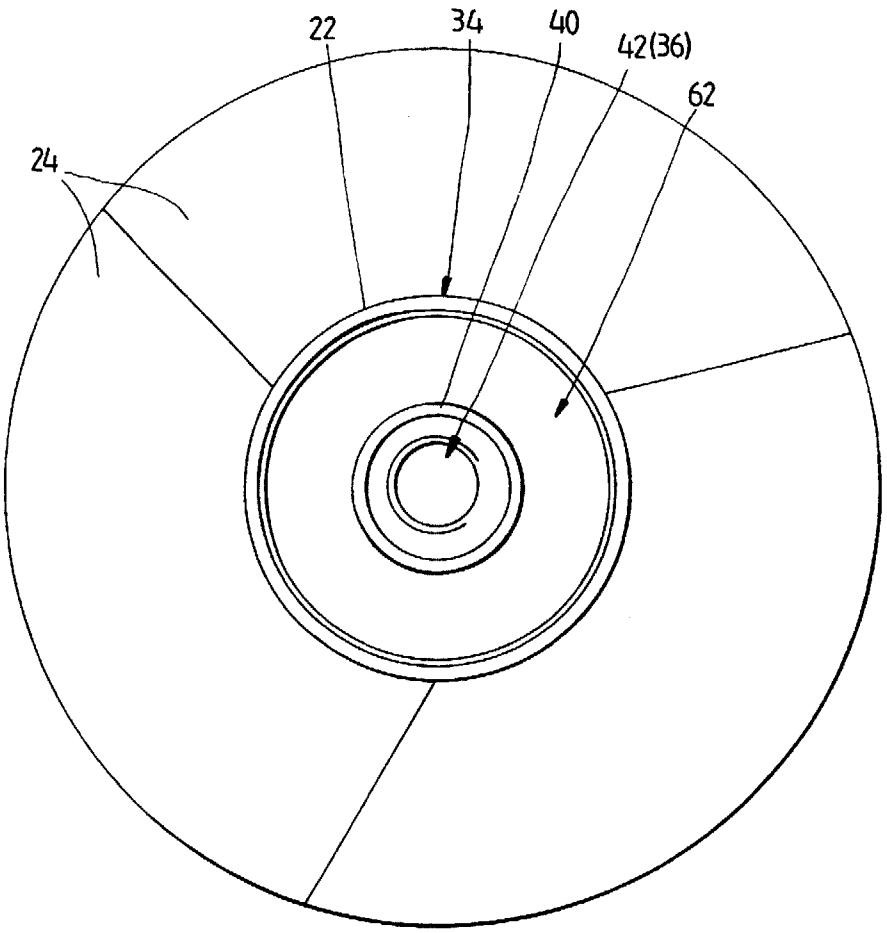
FIG. 6 shows a bottom view of the motorboat propeller embodied in the present invention.
Figure 5:
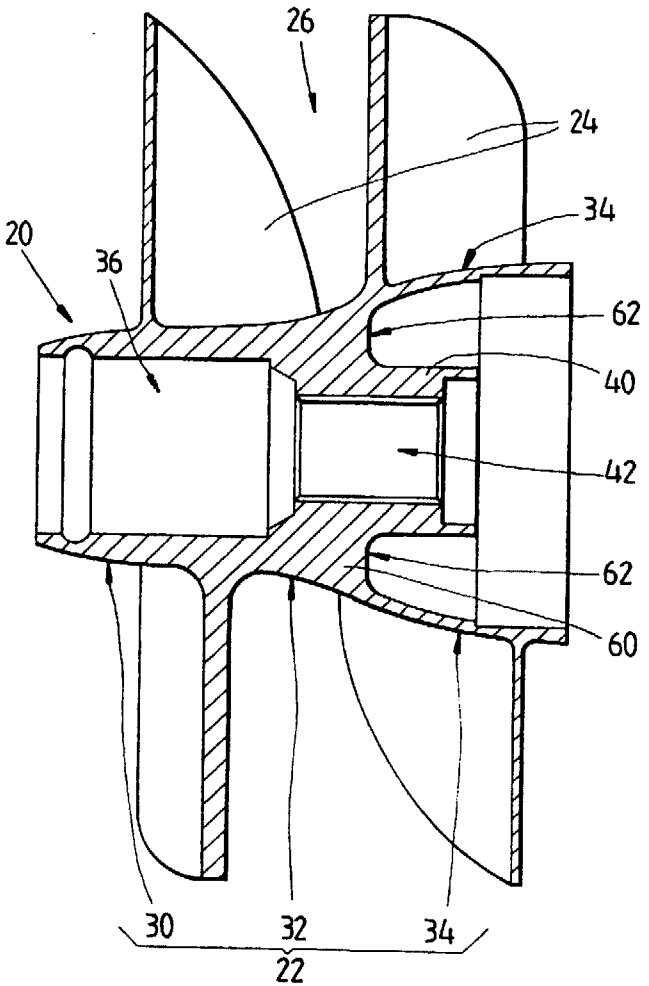
FIG. 5 shows a sectional view taken along the direction of the axis of the motorboat propeller of the present invention.

As shown in FIGS. 4–6, a motorboat propeller 20 embodied in the present invention is made of an aluminium alloy by casting and is composed of a hub 22 and three blades 24 mounted on the hub 22 such that the blades 24 rotate with the hub 22.

The hub 22 of a conelike construction is progressively greater in outer diameter from the outer end toward the inner end of the hub 22 and is composed of a front segment 30, a midsegment 32 and a rear segment 34, which extend in the direction of the axis of the hub 22. The blades 24 are mounted on the midsegment 32 and the rear segment 34 such that the blades 24 are spaced at the appropriate interval and angle, and that the head end 241 and the tail end 242 of two adjoining blades 24 are arranged side by side and substantially parallel to each other and perpendicular to the direction of the axis of the hub 22 so as to overlap and form a compression space 26 along with the blades 24, and the midsegment 32 (see FIG. 5). The compression space 26 is intended for use in accommodating and compressing the water passing through the compression space 26 so as to bring about an increase in the speed at which the backward discharge of water takes place.

The hub 22 has a hollow interior provided with a first axial hole 36 and a shaft tube 40. The first axial hole 36 has an appropriate length and extends from the outer end of the hub 22 in a direction toward the inner end of the hub 22. The shaft tube 40 has an appropriate length and extends in the inner periphery of the midsegment 32 along the direction of the axis of the hub 22 toward the inner end of the hub 22. The shaft tube 40 has an appropriate thickness and is provided at the center thereof with a second axial hole 42 coaxial with the first axial hole 36.

The motorboat propeller 20 of the present invention is characterized in that the periphery of the midsegment 32 of the hub 22 is slightly recessed, and that the peripheries of the front segment 30 and the rear segment 34 are slightly bulged, and further that the hub 22 is provided between the inner wall and the shaft tube 40 with a connection portion 60 which has an appropriate length and is located in the concave inner periphery 63 of the hub 22 such that the connection portion 60 is opposite in location to the midsegment 32. The connection portion 60 has an appropriate thickness and a ring-shaped correction end 62 facing the inner end of the hub 22. Access to the connection end 62 is facilitated by the concave inner periphery 63 of hub 22.

The motorboat propeller 20 of the present invention has inherent advantages, which are expounded explicitly hereinafter.

The propeller 20 of the present inventions is capable of generating a relatively greater backward thrust of water to propel the motorboat, thanks to the recessed periphery of the midsegment 32 of the hub 22 for enlarging the compression space 26 in which a relatively greater amount of water can be compressed to generate a greater backward thrust of water.

The work of correcting the center of gravity of the motorboat propeller 20 of the present invention can be done easily by cutting off portions of the correction end 62 of the connection portion 60.

The work of correcting the center of gravity of the motorboat propeller 20 does not require grinding the blades 24. As a result, the blades 24 remain intact structurally so as to ensure that the propelling capacity of the motorboat propeller 20 is not undermined.

The correction end 62 of the connection portion 60 of the propeller 20 of the present invention is of a ring-shaped construction to facilitate the identifying of a precise location at which the work of correcting the center of gravity of the propeller 20 is to be done.

What is claimed is:

1. A propeller, which comprises:

a hub having a periphery comprising along an axis of said hub, a front segment, a midsegment and a rear segment, said hub further having a hollow interior and a shaft tube extending along said axis of said hub;

a plurality of blades mounted at a predetermined interval on said periphery of said hub;

wherein said midsegment of said hub has a recessed periphery;

wherein said hub is provided between an inner periphery of said hub and an outer periphery of said shaft tube with a connection portion having a ring-shaped correction end;

wherein said connection portion is located within said midsegment of said hub;

wherein each of said blades has a head end and a tail end;

wherein each said head end respectively overlaps said tail end of another of said blades, said head end and said tail end being substantially parallel to each other and perpendicular to said axis of said hub; and wherein said recessed periphery of said midsegment is located between said head end and said tail end of each of said blades.

2. The propeller according to claim 1, wherein said inner periphery of said hub is concave to facilitate access to said connection end.

* * * * *